United States Patent [19]

Fincham et al.

[11] 4,002,255

[45] Jan. 11, 1977

[54] RECOVERY OF A COMMODITY FROM A SACHET OR BAG CONTAINING THE COMMODITY

[75] Inventors: Sydney Robert Fincham, Beckenham; Richard John Munday, Hornchurch, both of England

[73] Assignee: Tingey and Company (Engineers) Limited, London, England

[22] Filed: Apr. 4, 1975

[21] Appl. No.: 565,173

[52] U.S. Cl. ..... 214/305; 83/435

[51] Int. Cl.[2] ..... B65G 65/04

[58] Field of Search ..... 83/435, 435.2, 500, 83/501, 502, 503, 912, 422; 214/305, 308; 241/223, 236; 222/81, 82, 85, 87

[56] References Cited

UNITED STATES PATENTS

| | | | |
|---|---|---|---|
| 2,818,985 | 1/1958 | Irmscher | 214/305 |
| 3,386,602 | 6/1968 | Kanarek | 214/305 |
| 3,596,842 | 8/1971 | Barber | 214/305 |
| 3,863,790 | 2/1975 | Kanarek | 214/305 |

FOREIGN PATENTS OR APPLICATIONS

| | | | |
|---|---|---|---|
| 106,985 | 6/1965 | Norway | 214/305 |
| 359,511 | 10/1931 | United Kingdom | 83/435 |

*Primary Examiner*—Robert J. Spar
*Assistant Examiner*—Lawrence J. Oresky
*Attorney, Agent, or Firm*—Flynn & Frishauf

[57] ABSTRACT

Apparatus for recovering a commodity e.g. tea, from faulty bags containing the commodity has a conveyor to transport the bags to a cutting station having opposed pairs of slitting wheels and orbiting rollers, between neighboring pairs of slitting wheels, which engage and feed the bags steadily between the slitting wheels so as to be sliced thereby. A screening device is provided to receive the sliced bags from the conveyor and separate the commodity from the bag remnants.

11 Claims, 3 Drawing Figures

RECOVERY OF A COMMODITY FROM A SACHET OR BAG CONTAINING THE COMMODITY

This invention relates to the recovery of a commodity from a sachet or bag containing the commodity.

It is common for commodities to be packed in closed envelopes, sachets or bags, which in this specification will be referred to collectively as bags. The commodities can be particulate or liquid. Comestibles, cosmetic or pharmaceutical preparations and general household materials such as cleansers are examples of the many products which are packaged in bags.

During manufacture, faulty filled bags may be produced from time to time which have to be rejected during subsequent inspection or packing operations. It is considered desirable to open the faulty bags to recover the contents therefrom, particularly when the commodity is relatively precious, e.g. tea or coffee. The recovered contents can then be reprocessed and used again in the manufacture of fault-free bags.

SUMMARY OF THE INVENTION

According to one aspect of the present invention, there is provided apparatus for use in the recovery of a commodity from faulty bags containing the commodity, the apparatus including a conveyor, a cutting station and gripping means adjacent the cutting station which co-operate with the conveyor to feed bags into and through the cutting station; the cutting station including opposed slitting wheels whose cutting peripheries overlap and serve to shear bags fed therebetween. While only one pair of slitting wheels is essential, it is preferred that a plurality of pairs are provided, disposed alongside one another transverse to the path along which the bags are fed. It is found desirable to minimize the number of cuts made in each bag, and for cutting teabags of conventional size for instance, the approximate spacing between adjacent pairs of slitting wheels can be of the order of 20 mm. to give on average three cuts per teabag.

Conveniently, the cutting station is located intermediate the ends of the conveying path of the conveyor, which may comprise an endless loop composed of a plurality of conveyor strands. The overlapping cutting peripheries of a pair of slitting wheels are accommodated in a gap between adjacent conveyor strands. Where a multiplicity of slitting wheel pairs are employed, they are accommodated one pair to each gap of a multistranded conveyor.

The gripping means may comprise one or more pivoted rollers biased into contact with the conveyor so as to be rotated thereby, the gripping means and conveyor defining a nip in which the bags are gripped. The gripping means can be gravity-biased.

It is convenient to arrange that the conveying path is horizontal, in which case the opposed cutting discs can be mounted on upper and lower drive shafts positioned above and below the conveying flight of the conveyor. The or each pivoted roller comprising the gripping means can be pivotally supported on the upper drive shaft.

Bags to be cut open can be delivered to an entry end of the conveyor by feeding means including a hopper, chute, a second conveyor or the like. After cutting, the opened bags may be discharged by the conveyor on to screening means which operate to separate the commodity from remnants of the bags.

According to another aspect of the invention, there is provided a method of recovering a commodity from faulty bags the commodity, wherein faulty bags are conveyed to a cutting station and are passed between opposed slitting wheels to be severed thereby, and the cut bags being thereafter delivered to screening means for separating the commodity from the bag remnants.

BRIEF DESCRIPTION OF THE DRAWINGS

An embodiment of the invention will now be described by way of example only with reference to the accompanying drawings, in which.

DETAILED DESCRIPTION OF ILLUSTRATED EMBODIMENT

Figure 1:
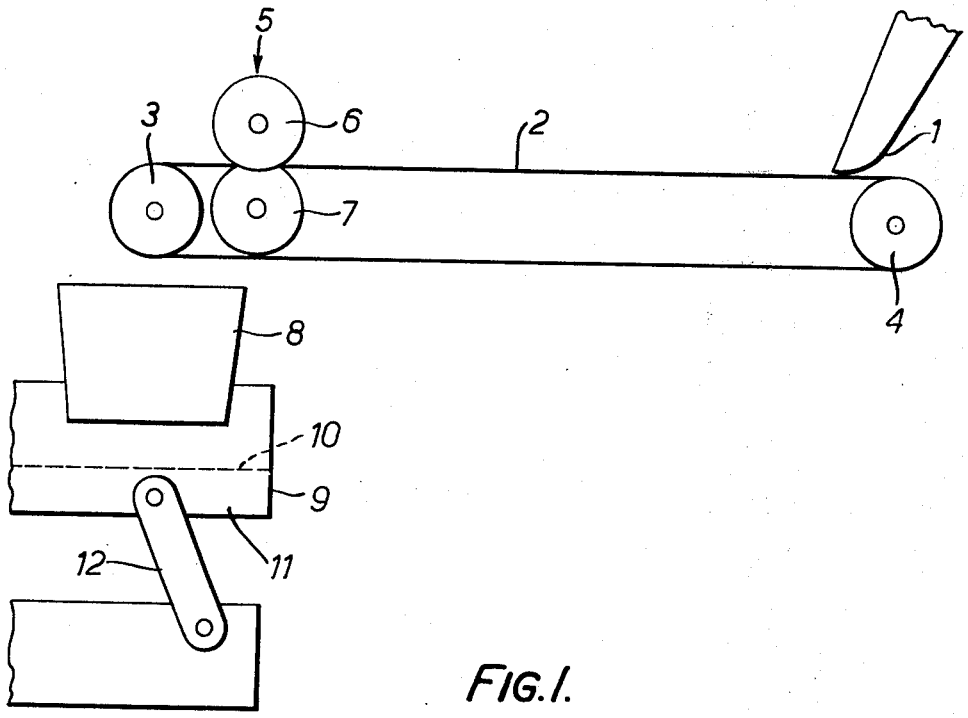
FIG. 1 is a diagrammatic side elevation of recovery machinery according to the invention for recovering tea from faulty teabags.

Teabags to be opened are delivered by feeding means (not shown) to a chute 1 and are dropped on to a multistranded belt conveyor 2. The multistranded belt conveyor 2 is trained around a drive roller 3 and a tensioning roller 4. The conveyor 2 is disposed with its upper flight generally horizontal, the upper flight defining a conveying path leading to and passing beyond a cutting station 5. The upper flight of the conveyor 2 passes between two counter-rotating cutter shafts 6, 7 each having cutters thereon. After travelling through the cutting station 5, the conveyor 2 delivers the cut teabags to a chute 8. The chute 8 deposits the teabags on to a screening conveyor means 9. The screening conveyor means has two conveying decks; the upper deck 10 being of mesh which retains the remains of the teabags while allowing tea to fall through on to the lower deck 11. The tea and the teabag remnants are conveyed on their respective decks 10, 11 to collecting containers (not shown). The tea collected can be subsequently reused and the teabag remnants disposed of or destroyed. The screening conveyor means is provided with an oscillatory drive of any convenient type and a resilient mounting 12.

Figure 2:
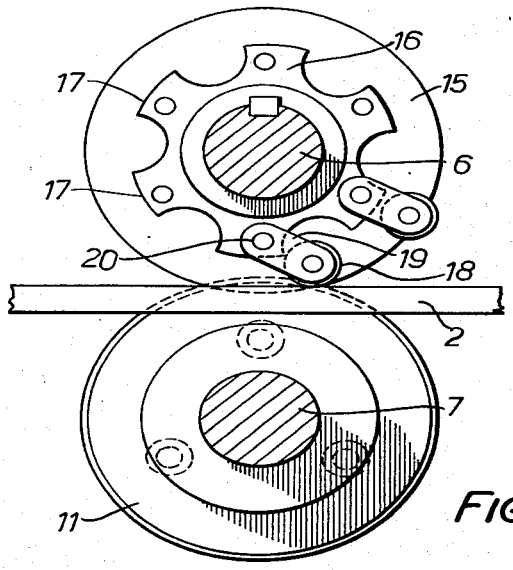
FIG. 2 is a sectional side elevation of feeding, gripping and cutting apparatus incorporated in the machinery shown in FIG. 1.
Figure 3:
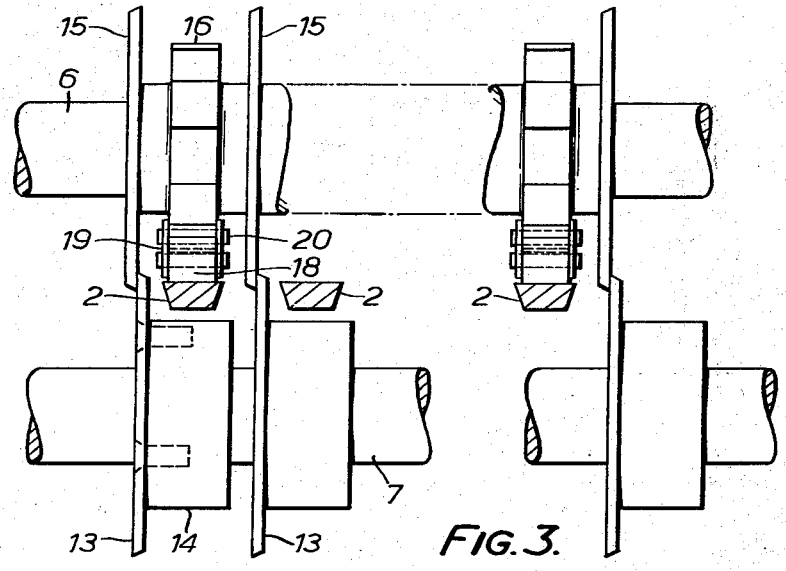
FIG. 3 is an end elevation of the apparatus shown in FIG. 2.

More details of the apparatus, and especially the cutting station, are visible in FIGS. 2 and 3. Bottom cutters 13 are supported on the bottom cutter shaft 7 by mounting collars 14 which in this case are clamped to the shaft by set screws. The cutters 13 comprise cutting wheels. Each strand of the upper flight of the multistranded belt conveyor 2 passes between an adjacent pair of the bottom cutters 13 and above the mounting collar 14 of one of the cutters as is clear from FIG. 3. The top cutter shaft 6 has mounted thereon top cutters 15 again in the form of cutting wheels. The spacing between adjacent pairs of bottom cutters 13 is equal to the spacing between adjacent pairs of top cutters 15. Opposed pairs of bottom and top cutters are arranged to shear or sever teabags fed thereto, and to achieve this action the sharp peripheries of each opposed pair overlap. The bottom and top opposed cutters are in close face-to-face proximity and their confronting faces lie in a common interface plane.

A spacer 16 is mounted between each pair of top cutters 15, on the top cutter shaft 6 for rotation therewith. The spacer 16 is equidistant from the adjacent top cutters 15. The spacer 16 has a plurality of radially-projecting arms 17 equispaced around the axis of the top shaft 6. Each arm serves as a mounting for gripping means which co-operates with the conveyor 2 to feed teabags into the cutting station 5. The gripping means here comprises sets of weighted rollers 18 rotatably mounted between links 19 which are pivoted on pins 20 passing through the arms 17. The rollers 18 are biased towards the conveyor 2 by gravity and centrifugal forces. The rollers 18 of each set are so positioned as always to run on the same associated strand of the conveyor 2, and the rollers 18 engage the strand in turn as their arms 17 rotate towards and successively pass the strand.

The paper from which teabags are made is extremely soft and flexible, but despite this the grip afforded by the nip between the orbiting rollers 18 and the moving conveyor 2 is able to generate a positive teabag feeding action to the cutting station 5.

In the preferred embodiment, there is a plurality of opposed cutter pairs 13, 15 and intervening rollers 18 arrayed across the width of the conveyor 2. In fact, 10 cutter pairs and 11 rollers are employed. The exact number of each is, broadly speaking, immaterial, and it is only necessary in principle to employ one cutter pair.

Again, where there is a plurality of cutter pairs 13, 15, their spacing or pitch is not critical. It is generally found preferable for the teabags to have the minimum number of cuts so as to eliminate a potential source of paper contamination in the tea recovered. As teabags are between 40 and 50mm wide, a pitch of 20mm between the cutter pairs is suitable. Only two or three cuts will then be made per bag. Means for rotating the top and bottom cutter shafts 6, 7 can be derived through appropriate gearing from the conveyor drive roller 3 or otherwise. The drive roller can be driven by an electric motor through a belt, chain or gear transmission.

We claim:

1. Apparatus for use in the recovery of a commodity from faulty bags containing the commodity, the apparatus including:

a cutting station, a conveyor for transporting bags towards and away from said cutting station, and gripping means adjacent said cutting station and operatively associated with said conveyor to feed said bags into said cutting station, said gripping means comprising at least one roller and at least one pivoted mounting rotatably carrying said at least one roller, said mounting being swingable to bring said at least one roller into biased contact with said conveyor so as to be rotated thereby, said roller defining a nip with said conveyor for gripping the bags, said cutting station comprising at least one pair of slitting wheels, each pair including opposed upper and lower slitting wheels in close face-to-face proximity, said slitting wheels of each pair having overlapping cutting peripheries operable to shear the bags when fed therebetween.

2. Apparatus according to claim 1, including a plurality of pairs of opposed slitting wheels, the pairs thereof being spaced apart from one another across the conveying path of said conveyor.

3. Apparatus according to claim 2, wherein the spacing between adjacent pairs of slitting wheels provides for an average of three cuts in each bag passed through the cutting station.

4. Apparatus according to claim 2, wherein said conveyor is an endless, multi-stranded conveyor the strands of which pass through said cutting station, and gaps between neighboring strands each accommodate said overlapping peripheries of a pair of opposed slitting wheels.

5. Apparatus according to claim 2, wherein said gripping means comprises sets of rollers pivotally mounted for biased contact with said conveyor so as to be rotated thereby and to define nips therewith for gripping the bags, there being a set of rollers disposed between neighboring upper slitting wheels and each set of rollers being mounted for rotation with said upper slitting sheels whereby each roller orbits in turn into contact with said conveyor.

6. Apparatus according to claim 5, comprising a spacer between neighboring upper slitting wheels and being rotatable therewith, said spacer having radially-projecting arms, a pivoted mounting carrying one roller of the set thereof being mounted to each of said arms.

7. Apparatus according to claim 1, wherein said at least one roller is gravity-biased against said conveyor.

8. Apparatus according to claim 1, wherein said at least one pivoted mounting is pivotally mounted on a shaft upon which the upper slitting wheel of said at least one pair of slitting wheels is mounted for rotation.

9. Apparatus according to claim 1, including drive means for said conveyor and further drive means for counter-rotating said slitting wheels, said further drive means being powered by a take-off from said conveyor drive means.

10. Apparatus according to claim 1, further including screening means for receiving cut bags discharged from said cutting station, said screening means comprising an upper and a lower deck for respectively retaining bag remnants and commodity released therefrom.

11. Apparatus according to claim 10, wherein said upper deck is supported on a resilient mounting and an oscillatory drive is provided to shake said upper deck to assist in the release of said commodity from said bag remnants.

* * * * *